US005467629A

United States Patent [19]

Albert

[11] Patent Number: 5,467,629

[45] Date of Patent: Nov. 21, 1995

[54] STRAIGHTENING APPARATUS FOR TUBULAR MATERIAL, WIRE AND CABLE

[75] Inventor: Eckehard Albert, Berlin, Germany

[73] Assignee: Witels Apparate-Maschinen Albert GmbH & Co. KG, Berlin, Germany

[21] Appl. No.: 222,845

[22] Filed: Apr. 5, 1994

[30] Foreign Application Priority Data

Apr. 6, 1993 [DE] Germany ..... 43 11 299.4

[51] Int. Cl.[6] ..... B21D 3/02

[52] U.S. Cl. ..... 72/164; 72/246; 72/236

[58] Field of Search ..... 72/164, 165, 246, 72/248, 199, 236, 244

[56] References Cited

U.S. PATENT DOCUMENTS

| | | | |
|---|---|---|---|
| 844,549 | 2/1907 | Spangler | 72/246 |
| 1,923,738 | 8/1933 | McBain | 72/165 |
| 2,254,461 | 9/1941 | Todd | 72/165 |
| 2,310,916 | 2/1943 | Gaines | 72/164 |
| 3,031,009 | 4/1962 | Muddiman | 72/165 |
| 3,218,835 | 11/1965 | Ward | 72/165 |
| 3,913,369 | 10/1975 | Field | 72/161 |
| 4,144,731 | 3/1979 | Ihle | 72/165 |
| 4,263,796 | 4/1981 | Vydrin | 72/238 |
| 4,551,878 | 11/1985 | Turley | 72/163 |
| 4,829,801 | 5/1989 | McRaine | 72/164 |

FOREIGN PATENT DOCUMENTS

| | | | |
|---|---|---|---|
| 9060 | 4/1970 | Japan | 72/165 |

*Primary Examiner*—Daniel C. Crane
*Attorney, Agent, or Firm*—Collard & Roe

[57] ABSTRACT

A straightening apparatus with a plurality of rotatable straightening rollers arranged in two parallel planes, with the axles of the rollers being supported in two body parts forming a basic chassis. The body parts are arranged relatively movable against each other on guides and have a closing mechanism. The body parts are maintained in a defined open position by the springs supported on the parts, and are movable by the closing mechanism into a closing position with a predetermined defined zero position, whereby the closing position is securable in the defined zero position by a releasable locking connection.

9 Claims, 1 Drawing Sheet

STRAIGHTENING APPARATUS FOR TUBULAR MATERIAL, WIRE AND CABLE

BACKGROUND OF THE INVENTION

1. Field of the Invention

The invention relates to a straightening apparatus.

More particularly, the invention relates to a straightening apparatus for wire, cable, and tubular material.

2. Description of the Prior Art

Straightening apparatus are known, for example, as shown in prospectus ER 5 of January 1984 of the firm Witels Apparate-Maschinen Albert GmbH & Co KG, in Berlin, Germany.

Conventional straightening apparatus are problematic with respect to the quality of straightening, and also with respect to the ease and speed of setting up such an apparatus. The known closing mechanisms for such an apparatus have an eccentric wheel with a lever connected thereto. The eccentric wheel uses the forces of friction in order to maintain the apparatus in a closed position. Thus, depending on the force applied to the lever, the closing mechanism will maintain the two body parts of the straightening apparatus in a zero or closed position. To open the apparatus, the lever is shifted to an open position whereby the user must then manually separate the two body parts by hand or by means of a tool. This requires an expenditure of time and effort by the user and also increases the risk of damage to the straightening device. With the increasing wear of the eccentric wheel due to friction, and the consistently occurring contaminations in the course of the operation, the zero or closed position of the straightening apparatus does not remain constant. Thus, the change in the zero-position leads to inaccuracies and flaws during the straightening process, thereby causing the straightened material to be rejected and discarded.

In the case where the straightening rollers are disposed rigidly within the apparatus, the inconsistency of the zero-position requires cleaning, exchanging of parts, and consistent adjustments in the apparatus.

In the case where at least part of the straightening rollers are arranged adjustably, the inconsistency of the zero-position requires costly readjustment of the individual straightening rollers.

SUMMARY OF THE INVENTION

It is, therefore, an object of the invention to provide a straightening apparatus such that a zero or closed position that is defined once is maintainable over longer periods of time without requiring any readjustment or exchange of parts.

It is another object of the invention to provide a straightening apparatus that reduces the wear on its individual parts.

Yet another object of the invention is to provide a straightening apparatus that reduces the potential for contamination of individual parts by foreign objects, and provides for superior control.

It is a further object of the invention to provide a straightening apparatus that operates efficiently and reliably.

The above and other objects are accomplished according to the invention by providing a straightening apparatus that can assume only two positions: a defined open position, and a defined closed position referred to as the zero-position, which is clearly fixed by the engagement of a releasable locking connection.

BRIEF DESCRIPTION OF THE DRAWINGS

Other objects and features of the present invention will become apparent from the following detailed description considered in connection with the accompanying drawing. It should be understood, however, that the drawing is designed for the purpose of illustration only, and not as a definition of the limits of the invention.

In the drawing, wherein similar reference characters denote similar elements throughout the several views.

DETAILED DESCRIPTION OF PREFERRED EMBODIMENTS

Figure 1:
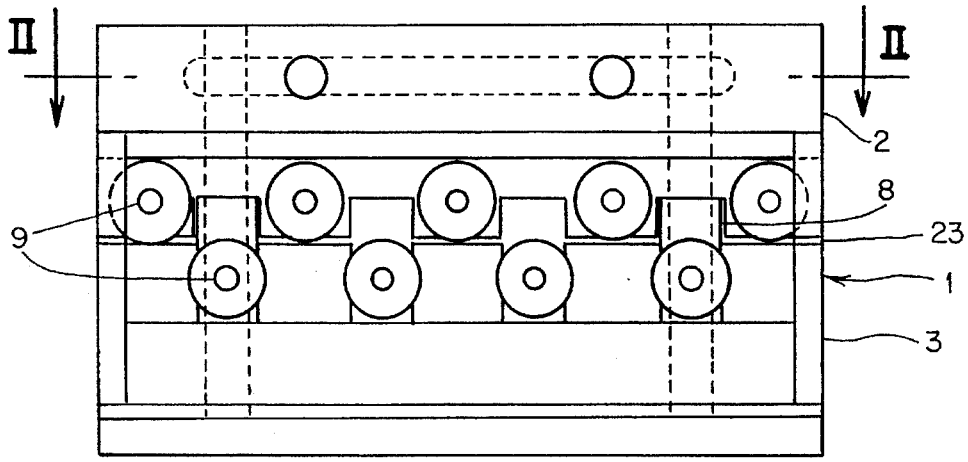
FIG. 1 is a top view of the straightening apparatus according to the invention in the closed position.

Referring now in detail to the drawings, FIG. 1 shows a basic body 1 consisting of two body parts 2 and 3. Body parts 2 and 3 are disposed on the two guide bolts 4 (FIG. 2) which are disposed parallel to each other and serve as guides. At one end, guide bolts 4 are rigidly connected with a body part 2 or 3, whereas the other body part 2 or 3 is slidably disposed on guide bolt 4. Guide bolts 4 are each arranged or fastened in a bore 5 extending through the basic body 1. Bore 5 has a first section 30 (FIG. 3) and a second section **36*a* disposed in body part 2, and a third and fourth section, 36*b* and 31 respectively disposed in body part 3. Sections 30 and 31 have a diameter "A" slightly larger than the diameter of guide bolt 4 such that said guide bolt can slide freely within bore 5. Sections 36*a* and 36*b* of bore 5 have a diameter "B" which is larger than diameter "A" of sections 30 and 31. The diametrical expansion on sections 36*a* and 36*b* provided ends 37*a* and 37*b* respectively for supporting a spiral spring 7. Spiral spring 7 is disposed within sections 36*a* and 36*b* and surrounds guide bolt 4 without interfering with the movement thereof. Each end of spiral spring 7 rests on the respective end 37*a* and 37*b* of the diametrically expanded sections 36*a* and 36*b* of bore 5. In the preferred embodiment, spiral spring 7 is covered by a protective sleeve 8. Protective sleeve 8 is dimensioned so that it does not interfere with body parts 2 and 3**, resting against each other in the zero (closed) position.

In the open position of the straightening apparatus, protective sleeve 8 completely covers spiral spring 7 and guide bolt 4 so that said spring, guide bolt, and their respective paths of movement are protected against contamination from foreign objects.

Body part 2 has an uneven number of straightening rollers 9 equally spaced from each other such that the space between each of said rollers is approximately equal to the diameter of each straightening roll 9. Body part 3 has an even number of straightening rollers 9 equally spaced from each other and disposed such that when the straightening apparatus is brought into its closed position, the space between each roll 9 of body part 2 is immediately opposite one of the straightening rollers of body part 3.

An eccentric wheel 10 (FIG. 3), in the form of a disk, is rotatably supported on each of the two lateral surfaces of body part 3. Eccentric wheel 10 is mounted on body part 2 by means of a fastening pin 12' via a pull rod 11, which in turn, is fastened on eccentric wheel 10 by means of a fastening pin 12. In the preferred embodiment, the eccentric wheel 10 connects both body parts 2 and 3 with a common operating lever 13, which is designed as a transparent protective hood. In the zero (closed) position of the straightening apparatus, the transparent protective hood (lever 13) completely covers straightening rollers 9 from the top.

Cover plates 14 and 14' are arranged on body parts 2 and 3 respectively, and project slightly beyond the height of straightening rollers 9 in their operating position. The lever 13 (i.e., the transparent protective hood) supports itself on one of said cover plates when the straightening apparatus is in the zero (closed) position.

Guide bolts 4 each have on their lower sides a transverse groove 15 directed at the bottom of the straightening apparatus. Transverse groove 15, in each case, receives one of the free ends 16 or 16' of a plate spring 18 centrally fastened in a recess in the bottom of the straightening apparatus by means of a screw 17. Plate spring 18 is prestressed such that it presses against, and locks in, transverse groove 15 when the body parts 2 and 3 are brought into their zero (closed) position.

Figure 2:
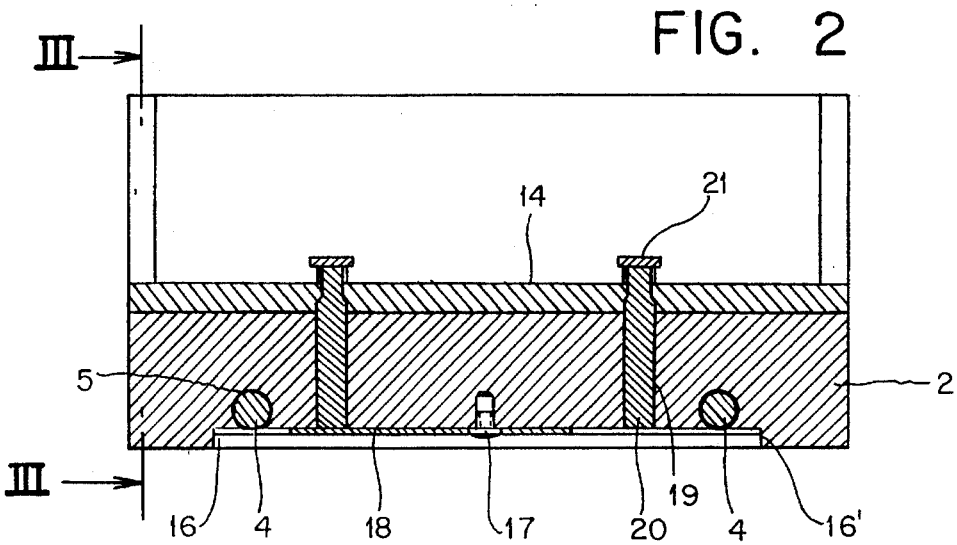
FIG. 2 is a cross-sectional view of the straightening apparatus taken along line II—II of FIG. 1.
Figure 3:
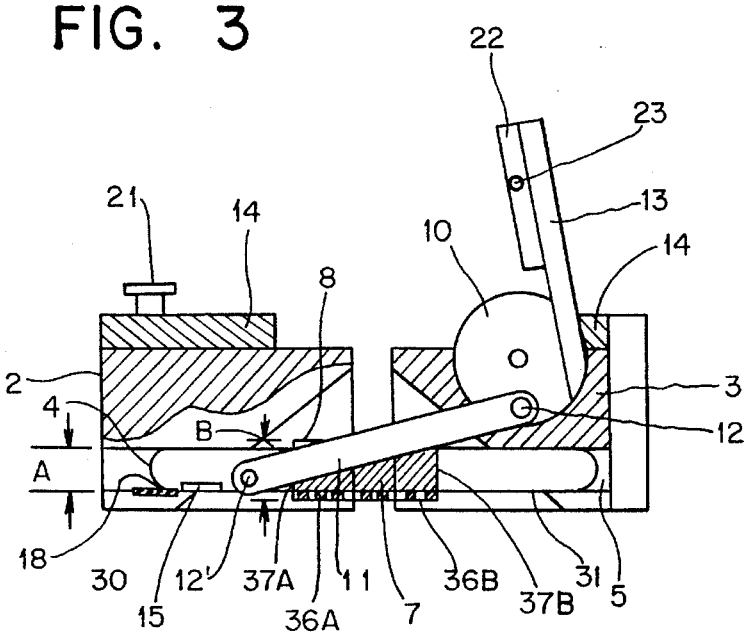
FIG. 3 is a cross-sectional view of the straightening apparatus in an open position taken along line III—III of FIG. 2.

Referring to FIG. 2, bores 19, disposed through body part 2 and cover plate 14, receive a releasing pin 20. A pressure cap 21, extending beyond cover plate 14, is fastened to the top end of releasing pin 20. The bottom or free end of releasing pin 20 is supported against plate spring 18. When pressure is applied to pressure cap 21, releasing pin 20 engages plate spring 18, in a downward motion, and releases said spring from the transverse grooves 15 (FIG. 3) in the guide bolts 4 thereby releasing the straightening apparatus from its zero (closed) position.

During operation, the bias of spiral springs 7 maintain the straightening apparatus in a first defined open position, whereby operating lever 13 (the protective hood) is in a nearly vertical position and permits clear access to the straightening rollers 9 for introducing a material to be straightened. At the same time, plate spring 18 is disposed outside the transverse grooves 15 of guide bolts 4. To close the straightening apparatus, operating lever 13 is shifted, from the practically vertical open position, into a horizontal position. Due to the eccentric wheel and pull rod connection, the two body parts 2 and 3 are moved toward each other against the force of spiral springs 7 until plate spring 18 snaps into the transverse grooves 15 in guide bolts 4. In this locked position the two body parts 2 and 3 and their respective straightening rollers 9 are arranged in a defined zero position (i.e., a closed position). To open the straightening apparatus, pressure is applied to releasing pins 20 via pressure caps 21. Releasing pins 20, under pressure, engage plate spring 18 such that the free ends 16 and 16' are moved from the transverse grooves 15 in guide bolts 4 so that spiral springs 7, if necessary with the supporting movement of operating lever 13, open the straightening apparatus and maintain it in the open position.

The protective hood (i.e., operating lever 13) may also have lateral cross walls 22 with a slot 23 or an eye for guiding or passing through a material to be straightened. This creates a nearly closed straightening space that is largely protected against any contamination from foreign particles.

In order to remove the dust and any other foreign particles that is caused by the contact of the material to be straightened with the straightening rollers, the straightening space may be connected with a vacuum source (not shown). The exhaust openings of the vacuum source are preferably arranged in the direction of movement of the material to be straightened, and within the immediate vicinity behind the point of contact between the straightening roll and the material to be straightened.

Since practically all moving parts are covered by the protective hood, the body parts or the protective sleeves, the straightening apparatus is significantly protected against fouling, so that an extended service life is possible. The zero (closed) position, which is reproducible in each case, assures a constant high quality over longer period of time because the zero (closed) position is, and always remains, exactly defined.

While one embodiment of the present invention has been shown and described, it is to be understood that many changes and modifications may be made thereunto without departing from the spirit and scope of the invention as defined in the appended claims.

What is claimed is:

1. A straightening apparatus for wire, cable and tubular material, comprising:

a plurality of rotatable straightening rollers arranged in two adjacent and parallel planes, wherein each of said rollers has an axle and defines a straightening space between adjacent rollers;

two body parts forming a basic chassis, said body parts supporting the axles of said straightening rollers, said body parts being disposed on guides and being relatively movable against each other;

springs supported on the body parts such that said parts are maintained in a defined open position;

a closing mechanism including an eccentric wheel rotably supported in one of said body parts, an operating lever fastened to said eccentric wheel, and a pull rod having one end connected to said eccentric wheel and the other end connected to the other of said body parts, said closing mechanism bringing said body parts and adjacent rollers into a closed position to form a predetermined defined zero position, said zero position defining the straightening space between adjacent rollers; and a releasable locking connection for securing the body parts in a closed position to maintain the defined zero position.

2. The straightening apparatus according to claim 1, wherein said operating lever is designed as a protective hood, covering all of said straightening rollers in the closed position.

3. The straightening apparatus according to claim 2, wherein the protective hood is transparent.

4. The straightening apparatus according to claim 2, wherein the protective hood has lateral cross walls with passage slots for receiving the material to be straightened.

5. The straightening apparatus according to claim 3, wherein the protective hood has lateral cross walls with passage slots for receiving the material to be straightened.

6. The straightening apparatus according to claim 1, wherein said releasable locking connection comprises a plate spring, and transverse grooves formed in the body part guides designed as parallel guide bolts, said grooves being adapted to said plate spring, and releasing pins for releasing the plate spring from its prestressed locked position in the transverse grooves.

7. The straightening apparatus according to claim 6, wherein said springs for maintaining the defined open position are arranged on the guide bolts.

8. The straightening apparatus according to claim 6, wherein in the open position of said body parts, the springs and the guide bolts are covered by protective sleeves.

9. The straightening apparatus according to claim 7, wherein in the open position of said body parts, the springs and the guide bolts are covered by protective sleeves.

* * * * *